US008867946B2

(12) United States Patent
Sobue

(10) Patent No.: US 8,867,946 B2
(45) Date of Patent: Oct. 21, 2014

(54) IMAGE FORMING SYSTEM USING PATTERN IMAGES FOR IMAGE FORMING ON TWO SIDES OF A SHEET

(75) Inventor: Fumitaka Sobue, Abiko (JP)

(73) Assignee: Canon Kabushiki Kaisha (JP)

( * ) Notice: Subject to any disclaimer, the term of this patent is extended or adjusted under 35 U.S.C. 154(b) by 472 days.

(21) Appl. No.: 12/873,798

(22) Filed: Sep. 1, 2010

(65) Prior Publication Data

US 2011/0076045 A1 Mar. 31, 2011

(30) Foreign Application Priority Data

Sep. 25, 2009 (JP) ..... 2009-220796

(51) Int. Cl.
*G03G 15/00* (2006.01)

(52) U.S. Cl.
CPC .. *G03G 15/5062* (2013.01); *G03G 2215/00556* (2013.01); *G03G 2215/00578* (2013.01); *G03G 2215/00599* (2013.01); *G03G 2215/00021* (2013.01)
USPC ..... 399/81; 399/310

(58) Field of Classification Search
USPC ..... 399/81, 231, 223
See application file for complete search history.

(56) References Cited

U.S. PATENT DOCUMENTS

| | | | | |
|---|---|---|---|---|
| 6,064,848 | A * | 5/2000 | Haneda | 399/302 |
| 2004/0234303 | A1 | 11/2004 | Shimizubata | |
| 2011/0044712 | A1* | 2/2011 | Tanaka | 399/72 |

FOREIGN PATENT DOCUMENTS

| | | | |
|---|---|---|---|
| JP | 11-212424 | A | 8/1999 |
| JP | 2002148890 | A | 5/2002 |
| JP | 2003-255775 | A | 9/2003 |
| JP | 2003-262990 | A | 9/2003 |
| JP | 2004-268572 | A | 9/2004 |
| JP | 2009-199375 | A | 9/2009 |

* cited by examiner

*Primary Examiner* — Quana M Grainger
(74) *Attorney, Agent, or Firm* — Rossi, Kimms & McDowell LLP

(57) ABSTRACT

Provided is an image forming system having a first image forming apparatus and a second image forming apparatus, the image forming system including: a first image forming unit provided to the first image forming apparatus and forming an image on a first surface of a recording sheet; and a second image forming unit provided to the second image forming apparatus and forming an image on a second surface of the recording sheet on the first surface of which the image has been formed by the first image forming unit, in which, when the first image forming unit and the second image forming unit form pattern images for image position adjustment on the recording sheet, the first image forming unit and the second image forming unit form a first pattern image and a second pattern image on the same surface of the recording sheet.

3 Claims, 9 Drawing Sheets

IMAGE FORMING SYSTEM USING PATTERN IMAGES FOR IMAGE FORMING ON TWO SIDES OF A SHEET

BACKGROUND OF THE INVENTION

1. Field of the Invention

The present invention relates to an image forming system for performing image formation on both surfaces of a recording sheet.

2. Description of the Related Art

In a conventional image forming system, as disclosed in Japanese Patent Application Laid-Open No. 2004-268572, a first image forming apparatus for performing image formation on a front surface of a recording sheet and a second image forming apparatus for performing image formation on a back surface of the recording sheet are connected to each other to perform the image formation on both the surfaces of the recording sheet.

The recording sheet on the front surface of which an image has been formed by the first image forming apparatus is transported to the second image forming apparatus with the front surface and the back surface being reversed. Then, the second image forming apparatus performs the image formation on the back surface of the recording sheet.

Japanese Patent Application Laid-Open No. H11-212424 discloses an image forming apparatus capable of adjusting a position of an image formed on a recording sheet by forming a pattern image for image position adjustment on the recording sheet and allowing a user thereof to examine the formed pattern image and input an adjustment value of the image position through an operation unit. In the image forming apparatus, a timing at which registration rollers perform image registration is adjusted based on the adjustment value of the image position input by the user.

In a case where the image position adjustment disclosed in Japanese Patent Application Laid-Open No. H11-212424 is performed in the image forming system disclosed in Japanese Patent Application Laid-Open No. 2004-268572, the first image forming apparatus forms the pattern image for the image position adjustment on the front surface of the recording sheet, and the second image forming apparatus forms the pattern image on the back surface of the recording sheet.

In this case, the pattern images are formed respectively on the front surface and the back surface of the recording sheet. Therefore, the user finds it difficult to input such an adjustment value that is appropriate to bring the image formation positions for the image forming apparatuses to coincide with each other. There is another problem that the user needs to examine both the pattern images on the front surface and the back surface of the recording sheet, which takes time and labor.

SUMMARY OF THE INVENTION

The present invention provides an image forming system, which allows a pattern image for image position adjustment to be easily examined without time and labor of a user thereof and which is capable of bringing image formation positions for a first image forming apparatus and a second image forming apparatus to coincide with each other.

In order to achieve the above-mentioned object, according to a first aspect of the present invention, an image forming system has a first image forming apparatus and a second image forming apparatus, the image forming system includes: a first image forming unit provided to the first image forming apparatus and forming an image on a first surface of a recording sheet; and a second image forming unit provided to the second image forming apparatus and forming an image on a second surface of the recording sheet on the first surface of which the image has been formed by the first image forming unit, wherein, when the first image forming unit and the second image forming unit form pattern images for image position adjustment on the recording sheet, the first image forming unit and the second image forming unit form a first pattern image and a second pattern image on the same surface of the recording sheet.

Further, according to a second aspect of the present invention, an image forming system has a first image forming apparatus and a second image forming apparatus, the image forming system includes: a first image forming unit provided to the first image forming apparatus and forming an image on a first surface of a recording sheet; and a second image forming unit provided to the second image forming apparatus and forming an image on a second surface of the recording sheet on the first surface of which the image has been formed by the first image forming unit, wherein, when the first image forming unit and the second image forming unit form pattern images for image position adjustment on the recording sheet, the first image forming unit forms a first pattern image on the recording sheet, and the second image forming unit forms a second pattern image for determining a positional displacement state with respect to the first pattern image on the same surface of the recording sheet on which the first pattern image has been formed.

Further features of the present invention will become apparent from the following description of exemplary embodiments with reference to the attached drawings.

DESCRIPTION OF THE EMBODIMENT

Figure 1:
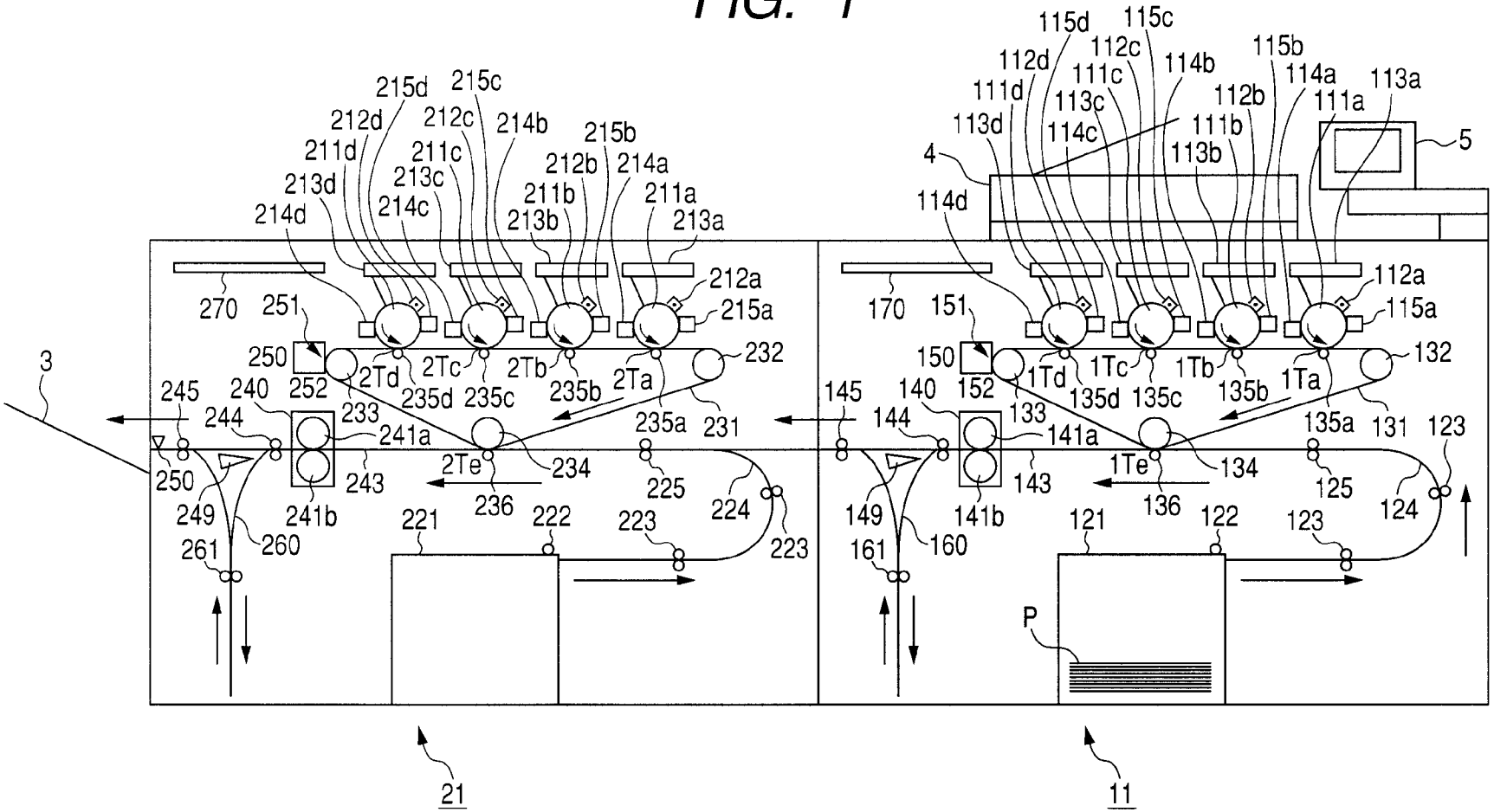
FIG. 1 is a sectional view illustrating an image forming system.

FIG. 1 is a sectional view of an image forming system.

In the image forming system according to an embodiment of the present invention, a first image forming apparatus 11 and a second image forming apparatus 21 are connected to each other. Each of the first image forming apparatus 11 and the second image forming apparatus 21 is a color image forming apparatus in which a plurality of image forming stations are disposed side by side.

A top part of the first image forming apparatus 11 is provided with an image reading apparatus 4 for reading an original image and an operation unit 5 for receiving an operation input by a user. The first image forming apparatus 11 includes a control unit 170 for controlling an operation of each mechanism inside the first image forming apparatus 11.

In the first image forming apparatus 11, four image forming stations having the same structure are disposed side by side. Primary chargers 112*a*, 112*b*, 112*c*, and 112*d*, exposure devices 113*a*, 113*b*, 113*c*, and 113*d*, and developing devices 114*a*, 114*b*, 114*c*, and 114*d* are respectively arranged so as to be opposed to outer peripheral surfaces of photosensitive drums 111*a*, 111*b*, 111*c*, and 111*d* driven to rotate in the arrow direction of FIG. 1.

The primary chargers 112*a*, 112*b*, 112*c*, and 112*d* each apply a charge having a uniform charging amount to surfaces of the photosensitive drums 111*a*, 111*b*, 111*c*, and 111*d*, respectively. The exposure devices 113*a*, 113*b*, 113*c*, and 113*d* each scan a light beam such as a laser beam modulated according to an image signal by rotation of a polygon mirror to irradiate the surfaces of the photosensitive drums 111*a*, 111*b*, 111*c*, and 111*d* with the light beam, to thereby form an electrostatic latent image thereon, respectively. The electrostatic latent images are visualized as toner images by the developing devices 114*a*, 114*b*, 114*c*, and 114*d* each containing developers (toner) in four colors of yellow (Y), magenta (M), cyan (C), and black (Bk), respectively.

Cleaning devices 115*a*, 115*b*, 115*c*, and 115*d* are provided on downstream sides of primary transfer areas 1Ta, 1Tb, 1Tc, and 1Td, respectively. In the primary transfer areas 1Ta, 1Tb, 1Tc, and 1Td, the visualized toner images are transferred onto an intermediate transfer belt 131. The cleaning devices 115*a*, 115*b*, 115*c*, and 115*d* clean the surfaces of the photosensitive drums 111*a*, 111*b*, 111*c*, and 111*d* by scraping remaining toner left untransferred off the photosensitive drums 111*a*, 111*b*, 111*c*, and 111*d*, respectively.

The intermediate transfer belt 131 is wound around a drive roller 132 for transmitting a driving force, a tension roller 133 for applying a moderate tension to the intermediate transfer belt 131, and an inner secondary transfer roller 134 opposed to a secondary transfer area 1Te across the intermediate transfer belt 131. The drive roller 132 is driven to rotate by an intermediate transfer drive motor (not shown).

The toner image formed on the photosensitive drum 111*d* disposed in the most upstream in a rotation direction of the intermediate transfer belt 131 is primarily transferred onto the intermediate transfer belt 131 in the primary transfer area 1Td by a primary transfer device 135*d* to which a high voltage is applied. The toner image that has been primarily transferred onto the intermediate transfer belt 131 is transported to the next primary transfer area 1Tc, and the toner image on the photosensitive drum 111*c* is transferred in alignment with the toner image on the intermediate transfer belt 131. The same process is repeated thereafter, and a four-color toner image is primarily transferred onto the intermediate transfer belt 131.

Recording sheets P stored in a cassette 121 are sent out one by one by a pickup roller 122, and transported along a feed guide 124 by a transport roller pair 123. After that, the recording sheet P is brought into abutment against registration rollers 125 that have stopped rotating, to thereby correct a skew feeding. The registration rollers 125 send out the recording sheet P to the secondary transfer area 1Te at a timing aligning with the toner image on the intermediate transfer belt 131. The toner image on the intermediate transfer belt 131 is transferred onto the recording sheet P in the secondary transfer area 1Te by a secondary transfer device 136 to which a high voltage is applied. The toner image is thus transferred onto the front surface (first surface) of the recording sheet P.

A cleaning device 150 for cleaning an image formation surface of the intermediate transfer belt 131 is provided in the downstream of the secondary transfer area 1Te in the rotation direction of the intermediate transfer belt 131. The cleaning device 150 includes a cleaner blade 151 and a waste toner box 152 for containing waste toner.

The recording sheet P that has passed through the secondary transfer area 1Te is guided to a fixing unit 140 via a transport guide 143. The fixing unit 140 includes: a fixing roller 141*a* including a heat source such as a halogen heater in an inside thereof; and a pressure roller 141*b* that is pressed against the fixing roller 141*a* (pressure roller 141*b* may include a heat source). The toner image on the recording sheet P is fixed to the recording sheet P by heat and pressure applied from the fixing unit 140.

The recording sheet P that has been transported from the fixing unit 140 is sent out by inner delivery rollers 144, and is then guided to a surface-reversing transport path 160 by a switching member 149 and transported by surface-reversing rollers 161. After that, the surface-reversing rollers 161 is caused to rotate reversely, and the recording sheet P is transported by outer delivery rollers 145 with the front surface and the back surface being reversed, thereby being transported from the first image forming apparatus 11 to the second image forming apparatus 21.

The recording sheet P that has been transported to the second image forming apparatus 21 passes through a transport guide 224, and is transported to registration rollers 225. The recording sheet P is brought into abutment against registration rollers 225 that have stopped rotating, to thereby correct a skew feeding. A toner image is formed on an intermediate transfer belt 231 through the same process as in the first image forming apparatus 11. The registration rollers 225 send out the recording sheet P to a secondary transfer area 2Te at a timing aligning with the toner image on the intermediate transfer belt 231. The toner image on the intermediate transfer belt 231 is transferred onto the recording sheet P in the secondary transfer area 2Te by a secondary transfer device 236 to which a high voltage is applied. The toner image is thus transferred onto the back surface (second surface) of the recording sheet P.

The recording sheet P that has passed through the secondary transfer area 2Te is guided to a fixing unit 240 via a transport guide 243. The fixing unit 240 is the same in structure as the above-mentioned fixing unit 140, and performs a fixing operation by applying heat and pressure on the toner image on the recording sheet P. The recording sheet P that has been transported from the fixing unit 240 is sent out by inner delivery rollers 244, and is then delivered to a delivery tray 3 by outer delivery rollers 245. A sensor 250 for detecting delivery of the recording sheet P is provided on the downstream side of the outer delivery rollers 245. Images are formed on both sides of the recording sheet P according to the above-mentioned procedure.

Figure 2:
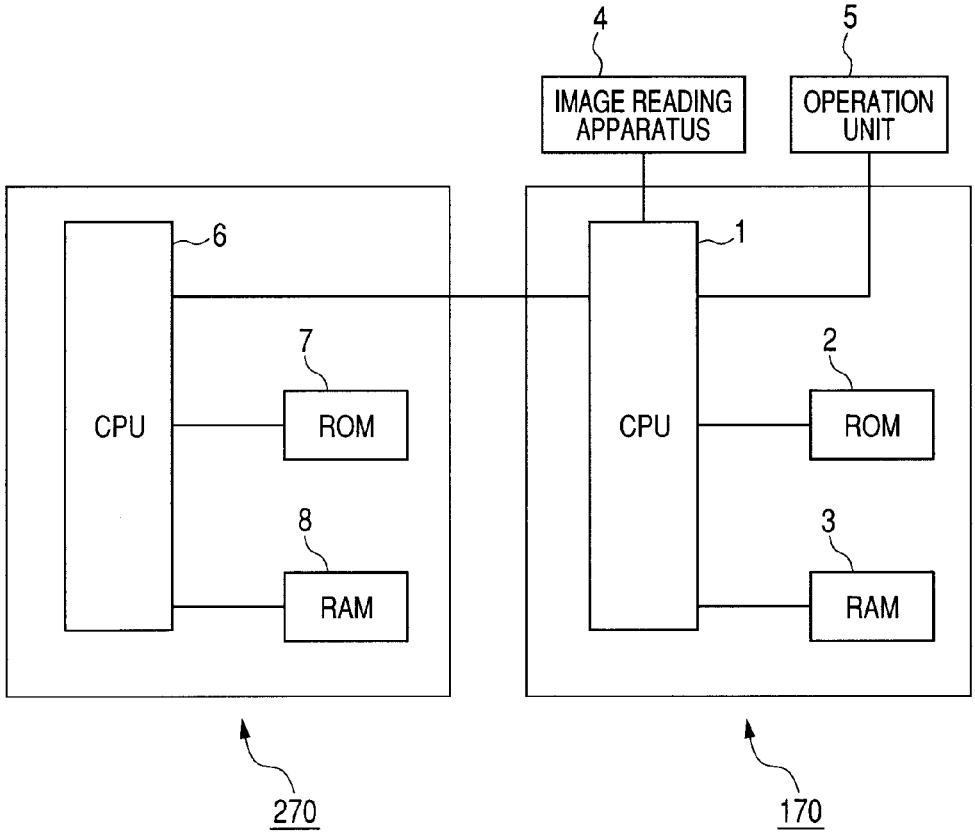
FIG. 2 is a block diagram illustrating the image forming system.

FIG. 2 is a block diagram of the image forming system.

A central processing unit (CPU) 1 is a control circuit provided to the control unit 170, for controlling an entirety of the first image forming apparatus 11. A read-only memory (ROM) 2 stores a control program for controlling various kinds of processing to be executed by the first image forming apparatus 11. A random access memory (RAM) 3 is a system work memory used for the operation of the CPU 1, and also functions as an image memory for temporarily storing image data. The CPU 1 is connected to the image reading apparatus 4, the operation unit 5, and a CPU 6.

The CPU 6 is a control circuit provided to a control unit 270, for controlling an entirety of the second image forming apparatus 21. A ROM 7 stores a control program for controlling various kinds of processing to be executed by the second image forming apparatus 21. A RAM 8 is a system work memory used for the operation of the CPU 6, and also functions as an image memory for temporarily storing image data.

The user can cause the CPU 1 to switch over an image forming operation mode or display of the operation unit 5 by using an input key on the operation unit 5. The user can also cause the CPU 1 to execute an image position adjustment mode by using the input key on the operation unit 5.

Figure 3:
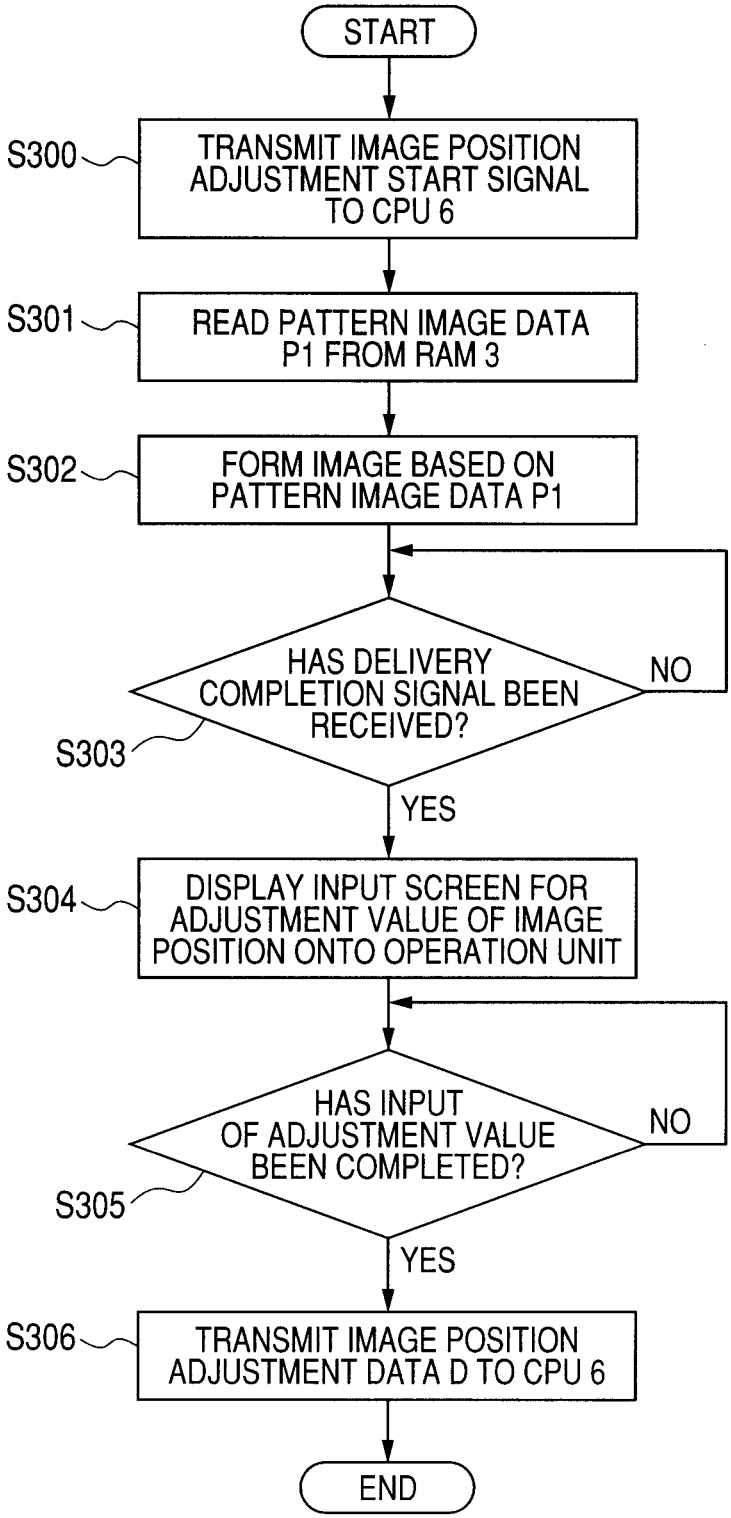
FIG. 3 is a flowchart illustrating image position adjustment processing executed by a central processing unit (CPU) 1.
Figure 4:
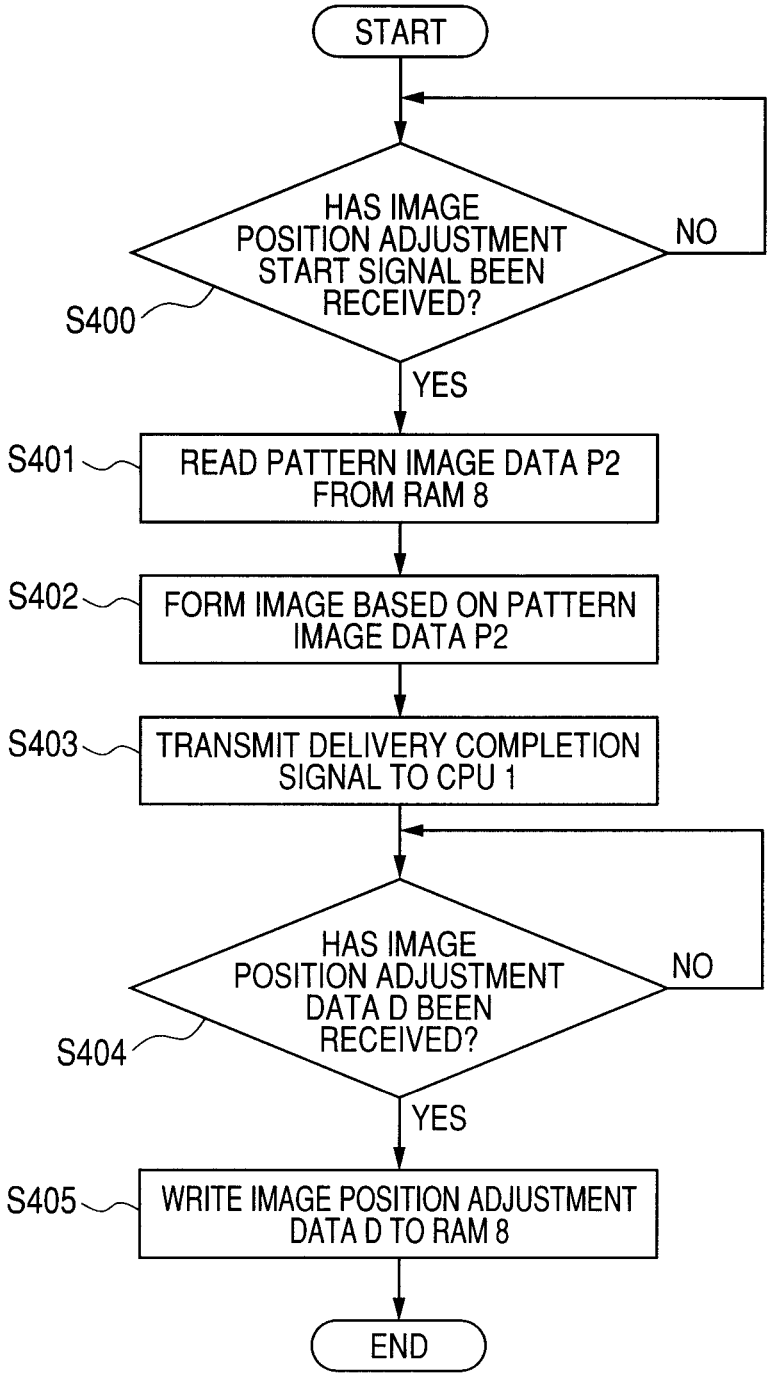
FIG. 4 is a flowchart illustrating image position adjustment processing executed by a CPU 6.

FIG. 3 is a flowchart illustrating image position adjustment processing executed by the CPU 1. FIG. 4 is a flowchart illustrating image position adjustment processing executed by the CPU 6.

A program for executing the processing illustrated by the flowchart of FIG. 3 is stored in the ROM 2 and executed by being read by the CPU 1. A program for executing the processing illustrated by the flowchart of FIG. 4 is stored in the ROM 7 and executed by being read by the CPU 6.

Before the processing illustrated by the flowcharts of FIGS. 3 and 4 is executed, adjustment of an image formation position by the first image forming apparatus 11 is completed by using a conventional method (for example, the method disclosed in Japanese Patent Application Laid-Open No. H11-212424). The flowcharts of FIGS. 3 and 4 illustrate processing of allowing the user to input an adjustment value for adjusting an image formation position for the second image forming apparatus 21 so that the image formation position coincides with the image formation position for the first image forming apparatus 11 the adjustment of which has already been completed.

When the user instructs execution of the image position adjustment mode through the operation unit 5, the CPU 1 transmits an image position adjustment start signal to the CPU 6 (S300). Then, the CPU 1 reads pattern image data P1 of the first image forming apparatus 11 from the RAM 3 (S301).

The CPU 1 causes a first pattern image to be formed on the recording sheet P, based on the pattern image data P1 (S302). The recording sheet P on which the first pattern image has been formed is transported to the second image forming apparatus 21 without the front surface and the back surface being reversed by the switching member 149 and the surface-reversing rollers 161.

The description is continued by referring to FIG. 4. The CPU 6 determines whether or not the image position adjustment start signal transmitted by the CPU 1 in Step S300 has been received (S400). If the image position adjustment start signal is received, the CPU 6 reads pattern image data P2 of the second image forming apparatus 21 from the RAM 8 (S401).

The CPU 6 causes a second pattern image to be formed on the recording sheet P transported from the first image forming apparatus 11, based on the pattern image data P2 (S402). The recording sheet P on which the second pattern image has been formed is delivered to the delivery tray 3 without the front surface and the back surface being reversed by a switching member 249 and surface-reversing rollers 261. When the sensor 250 detects a trailing edge of the recording sheet P, the CPU 6 transmits a delivery completion signal to the CPU 1 (S403).

Figure 5:
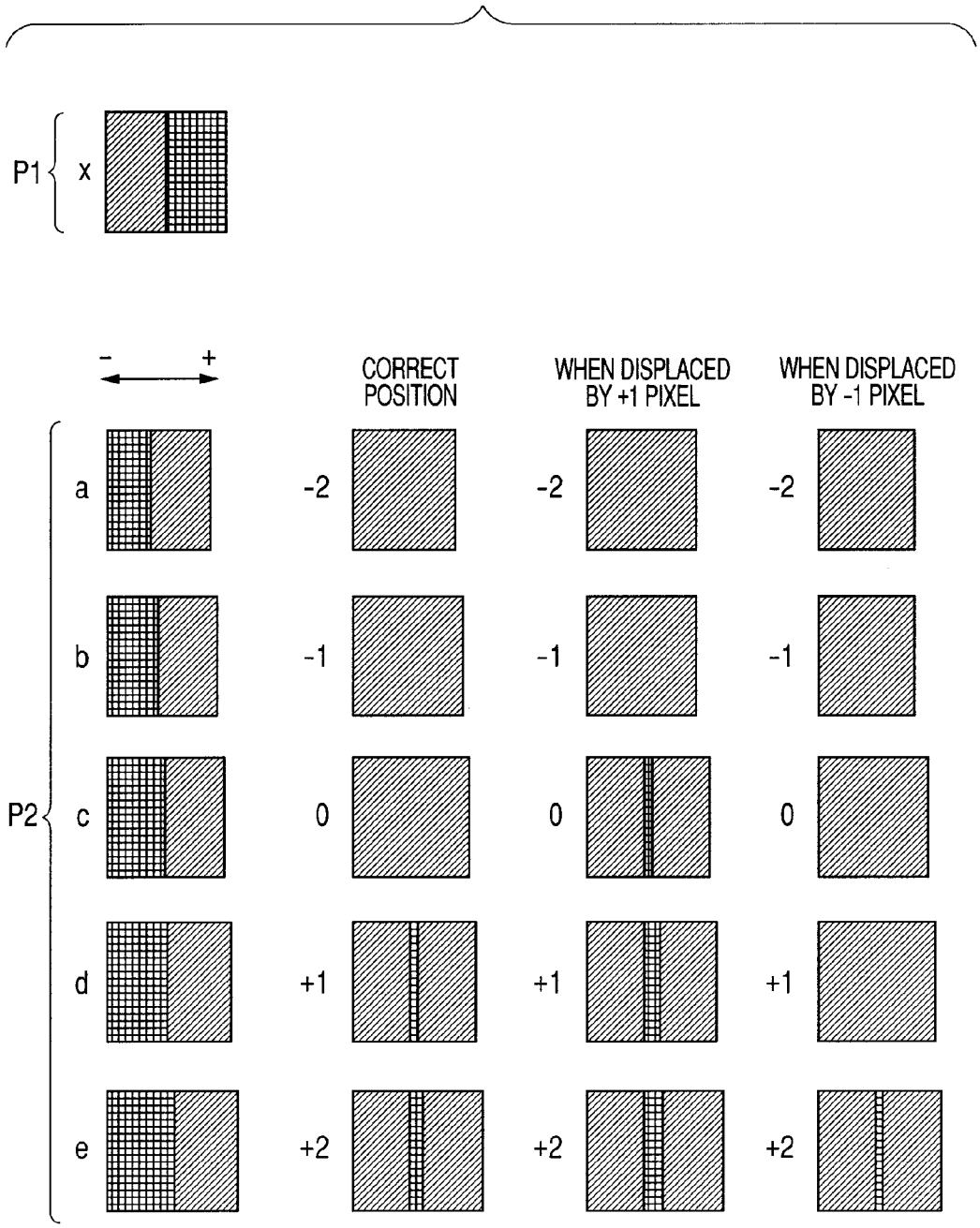
FIG. 5 illustrates formation of pattern images used for detecting image positional displacement in a sub scanning direction.

With reference to FIG. 5, formation of a pattern image for detecting image positional displacement in a sub scanning direction (sheet transport direction) is described.

The first image forming apparatus 11 forms a plurality of pattern images x based on the pattern image data P1 on the recording sheet P. Then, the second image forming apparatus 21 receives the recording sheet P on which the plurality of pattern images x have been formed by the first image forming apparatus 11. The second image forming apparatus 21 forms pattern images a to e on the recording sheet P so that left edges of the pattern images a to e based on the pattern image data P2 are aligned with left edges of the plurality of pattern images x formed by the first image forming apparatus 11.

Pattern images formed by overlaying the pattern images a to e respectively on the plurality of pattern images x are illustrated by being arranged next to the pattern images a to e of FIG. 5. In addition, a numeral printed next to each of the pattern images indicates the number of pixels by which the formed pattern image is displaced in the sub scanning direction. As the positional displacement direction, a rightward direction of FIG. 5 is indicated by a plus sign (+), and a leftward direction of FIG. 5 is indicated by a minus sign (−). For example, "0" is printed next to the pattern image c because the left side of an image portion of the pattern image c coincides with the right side of an image portion of the pattern image x without positional displacement, while "−2" is printed next to the pattern image a because the pattern image a is displaced leftward by two pixels.

A case is described where the image formation position for the second image forming apparatus 21 is displaced with respect to the image formation position for the first image forming apparatus 1. For example, in a case where the pattern image c is formed by being overlaid on the pattern image x in a correct position by the second image forming apparatus 21, a pattern image without a gap is formed. In a case where the pattern image c is formed by being overlaid in a position displaced by +1 pixel by the second image forming apparatus 21, a pattern image having a blank line corresponding to one pixel is formed. In a case where the pattern image c is formed by being overlaid in a position displaced by −1 pixel, a pattern image is formed in which a width of the image portion in the sub scanning direction is smaller by one pixel than a width in the case where the pattern image is formed by being overlaid in the correct position.

Figure 6:
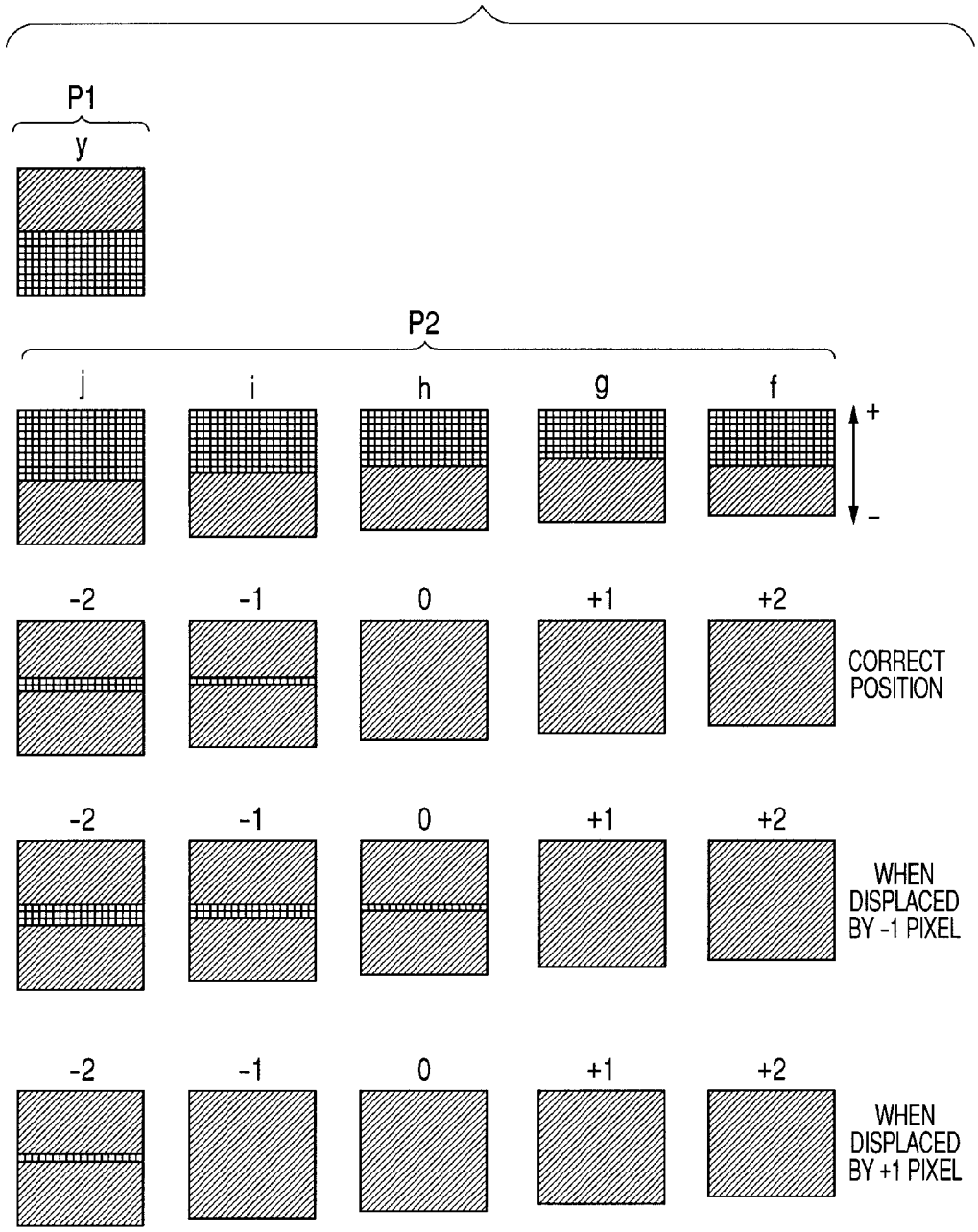
FIG. 6 illustrates formation of pattern images used for detecting the image positional displacement in a main scanning direction.

With reference to FIG. 6, formation of a pattern image for detecting image positional displacement in a main scanning direction (direction perpendicular to the sheet transport direction) is described.

In this case, as described with reference to FIG. 5, the second image forming apparatus 21 forms pattern images f to j based on the pattern image data P2 on a plurality of pattern images y formed based on the pattern image data P1 by the first image forming apparatus 11.

Figure 7:
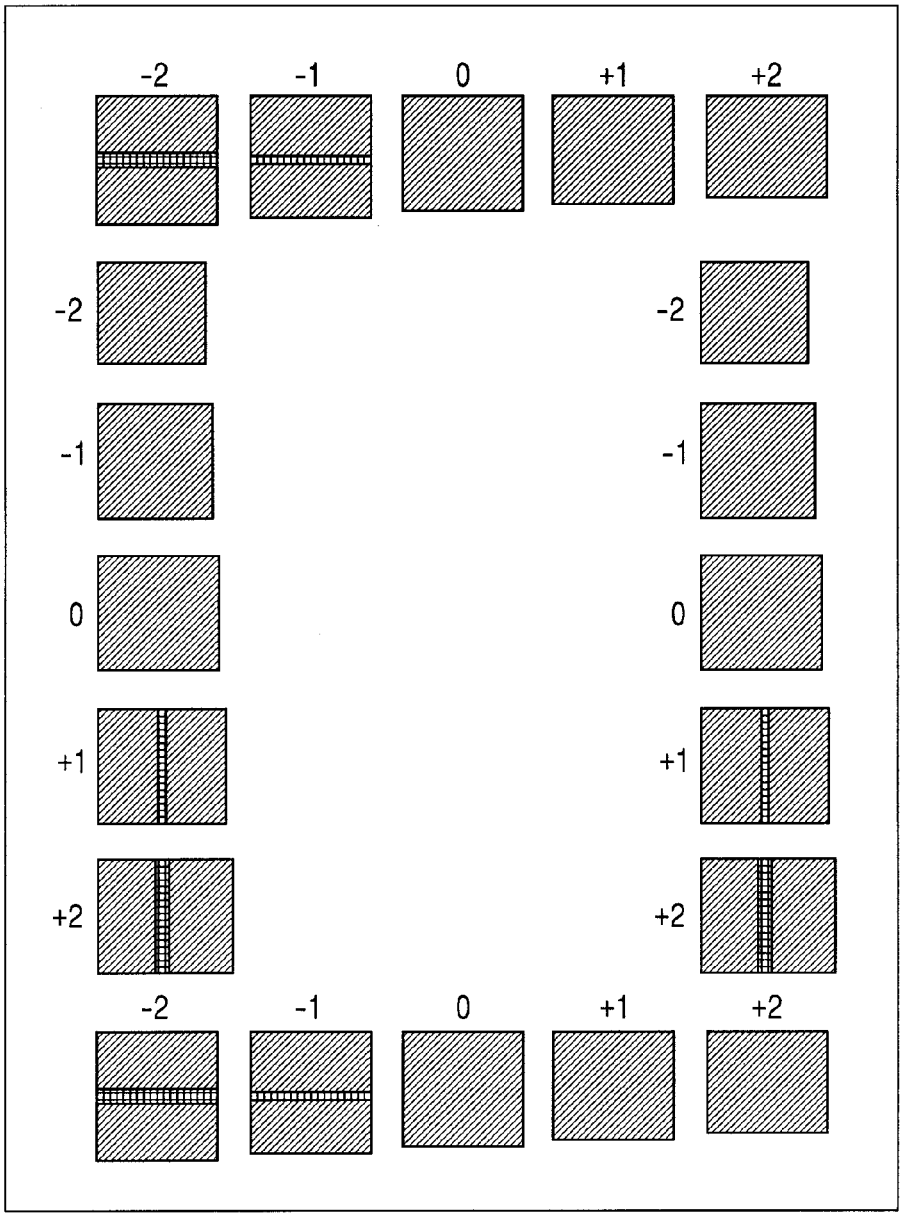
FIG. 7 illustrates the pattern images formed on a recording sheet in actuality.

FIG. 7 illustrates the pattern images formed on the recording sheet in actuality.

As illustrated in FIG. 7, the pattern images are formed by being arranged along the four sides, namely, top/bottom/left/right sides, of the recording sheet P. By forming the pattern images along the top/bottom sides of the recording sheet P, the image positional displacement and magnification deviation in the main scanning direction may be detected. In addition, by forming the pattern images along the left/right sides of the recording sheet P, it is possible to detect the image positional displacement and the magnification deviation in the sub scanning direction.

The description is continued by referring again to FIG. 3. The CPU 1 determines whether or not the delivery completion signal transmitted from the CPU 6 in Step S403 is received (S303). If the delivery completion signal is received, the CPU 1 displays an input screen for an image position adjustment value illustrated in FIG. 8 onto a display portion provided to the operation unit 5 (S304), to thereby prompt the user to input adjustment values of the four image positions, namely, top/bottom/left/right. The user examines the pattern images formed on the recording sheet illustrated in FIG. 7 and inputs the numerals added to the pattern images that exhibit no positional displacement, as the adjustment values. Details thereof are described later.

The CPU 1 waits until the input of the adjustment values performed by the user is completed (S305). The input data is set as image position adjustment data D and used as image position adjustment data in the next image forming operation to be performed by the second image forming apparatus 21. When the input performed by the user is completed, the CPU 1 transmits the image position adjustment data D to the CPU 6 (S306).

The description is continued by referring again to FIG. 4. The CPU 6 waits until the image position adjustment data D transmitted from the CPU 1 in Step S306 is received (S404). When the image position adjustment data D is received, the CPU 6 writes the image position adjustment data D to the RAM 8 (S405). The image position adjustment data D is used as data for adjusting the image formation position for the second image forming apparatus 21 so that the image formation position coincides with the image formation position for the first image forming apparatus 11.

In this embodiment, the image position adjustment is performed by reflecting the image position adjustment data D on control of at least one image forming condition for the second image forming apparatus 21 described below.

(1) timing of main scanning/sub scanning writing performed by exposure devices 213*a*, 213*b*, 213*c*, and 213*d*

(2) motor rotation cycle for driving polygon mirrors of the exposure devices 213*a*, 213*b*, 213*c*, and 213*d*

(3) transport position of the recording sheet P in the main scanning direction (4) transport timing of the registration rollers 225

(5) transport speed of the recording sheet P

Figure 8:
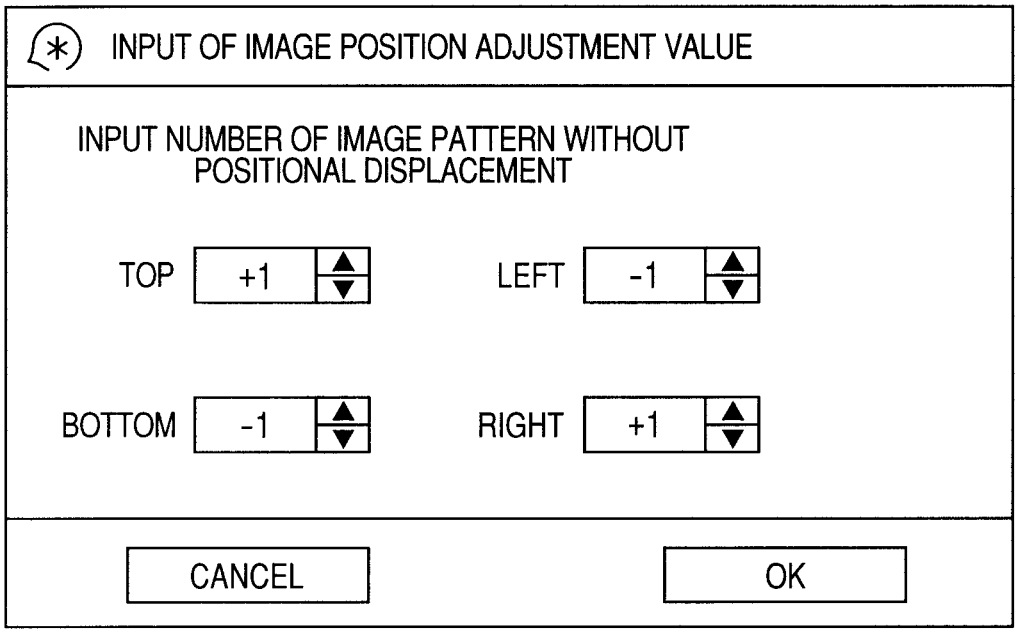
FIG. 8 illustrates an input screen for image position adjustment values.
Figure 9:
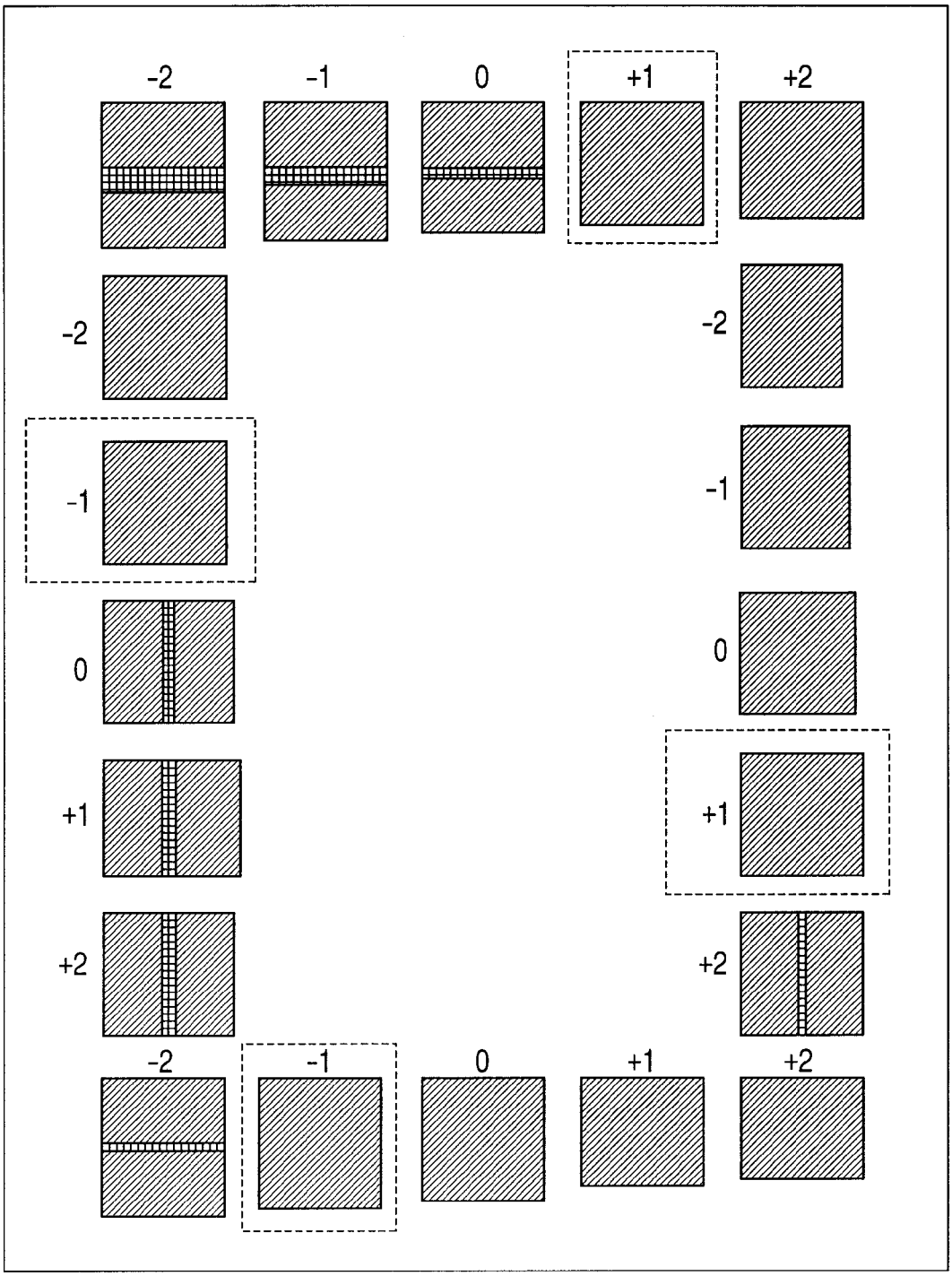
FIG. 9 illustrates the pattern images formed on the recording sheet in actuality.

This embodiment is described specifically by referring to FIG. 9. Such a case as illustrated in FIG. 9 is taken as an example, in which the top pattern image with "+1" formed on the recording sheet P exhibits no positional displacement and the bottom pattern image with "−1" exhibits no positional displacement. In this case, as illustrated in FIG. 8, the user inputs the top adjustment value as "+1" and the bottom adjustment value as "−1" by using the operation unit 5.

Images formed by the second image forming apparatus 21 are different in magnification by two pixels between the top/bottom pattern images. Therefore, in this case, the speed of the motor driving the polygon mirror of the second image forming apparatus 21, for example, is changed so as to change the magnification by two pixels between the top/bottom pattern images. When the speed of the motor driving the polygon mirror is changed, a sub scanning position is displaced. Hence, the magnification and position adjustment in the sub scanning direction are performed by changing an image writing timing for the exposure device of the second image forming apparatus 21 and the transport timing/transport speed of the recording sheet P, according to a change amount of the speed.

As illustrated in FIG. 9, in a case where the right pattern image with "+1" formed on the recording sheet P exhibits no positional displacement and the left pattern image with "−1" exhibits no positional displacement, the user inputs the right adjustment value as "+1" and the left adjustment value as "−1" by using the operation unit 5. In this case, the images formed by the second image forming apparatus 21 are different in magnification by two pixels between the left/right pattern images. Therefore, in this case, control of the image writing timing for the exposure device of the second image forming apparatus 21, for example, is performed so as to change the magnification by two pixels between the left/right pattern images.

As described above, in this embodiment, the first image forming apparatus 11 and the second image forming apparatus 21 are configured to form the pattern images for the image position adjustment so as to have a predetermined positional relationship therebetween on the same surface of the recording sheet P. Accordingly, the pattern images can easily be examined without time and labor of the user, and it is possible to bring the image formation position for the first image forming apparatus 11 and the image formation position for the second image forming apparatus 21 to coincide with each other.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2009-220796, filed Sep. 25, 2009, which is hereby incorporated by reference herein in its entirety.

What is claimed is:

1. An image forming system comprising:

a first image forming apparatus configured to form a first image on a first surface of a recording sheet;

a second image forming apparatus configured to form a second image on a second surface of the recording sheet after the first image is formed on the first surface by the first image forming apparatus; and a control unit configured to control the first image forming apparatus so as to form first pattern images for image position adjustment on the recording sheet, the control unit configured to control the second image forming apparatus so as to form second pattern images for image position adjustment on the recording sheet;

wherein the second image forming apparatus forms the second pattern images so that the second pattern images are shifted relative to each other and overlaid on the first pattern images formed by the first image forming apparatus;

the image forming system further comprising:

a surface-reversing unit for reversing the recording sheet on which the first image has been formed by the first image forming apparatus, wherein, when performing image formation on both surfaces of the recording sheet, the control unit causes the first image forming apparatus to form the first image on the first surface of the recording sheet, causes the surface-reversing unit to reverse the recording sheet on the first surface of which the first image has been formed, and causes the second image forming apparatus to form the second image on the second surface of the recording sheet which has been reversed.

2. An image forming system according to claim 1, wherein, when forming the first and second pattern images for the image position adjustment on the recording sheet, the control unit prevents the surface-reversing unit from reversing the recording sheet.

3. An image forming system according to claim 1, wherein the first and second pattern images for the image position adjustment formed by overlaying the second pattern image on the first pattern image are formed by being arranged along top/bottom/left/right sides of the recording sheet.

* * * * *